US006782850B2

(12) United States Patent
Tapia P.

(10) Patent No.: US 6,782,850 B2
(45) Date of Patent: Aug. 31, 2004

(54) TWO STROKE ENGINE HAVING REDUCED HEIGHT PISTONS

(76) Inventor: Héctor L. Tapia P., M.Arredondo 2539, Los Cipreses, Lima 1 (PE)

( * ) Notice: Subject to any disclaimer, the term of this patent is extended or adjusted under 35 U.S.C. 154(b) by 0 days.

(21) Appl. No.: 09/815,000

(22) Filed: Mar. 23, 2001

(65) Prior Publication Data

US 2002/0134325 A1 Sep. 26, 2002

(51) Int. Cl.[7] ..... F02B 33/00
(52) U.S. Cl. ..... 123/71 R; 123/65 PE
(58) Field of Search ..... 123/71 R, 71 V, 123/65 PE

(56) References Cited

U.S. PATENT DOCUMENTS 2,183,116 A * 12/1939 Coates ..... 123/71 R
2,689,679 A * 9/1954 Wales ..... 123/71 R
3,550,569 A * 12/1970 Hooper ..... 123/71 R
4,185,597 A * 1/1980 Cinquegrani ..... 123/71 R
5,050,570 A * 9/1991 Thring ..... 123/71 R
5,791,303 A * 8/1998 Skripov ..... 123/71 R
5,884,590 A * 3/1999 Minculescu ..... 123/71 R

* cited by examiner

*Primary Examiner*—Henry O. Yuen
*Assistant Examiner*—Jason Benton

(57) ABSTRACT

Modification to the current two-stroke cycle internal combustion engine, using reduced height piston constructed solidly with piston rods and having rotary valves installed in the transfer and exhaust ports. The piston pre-compresses the fuel-air mix in its lower part without allowing it to enter the crankcase, using auxiliary one-way flow valves operated directly by pressure differentials and transfer parts for the fuel air-mix from the lower part of the piston to the upper part, and a receiving chamber interposed to maintain the pre-compresed fuel-air mixture temporarily.

4 Claims, 4 Drawing Sheets

TWO STROKE ENGINE HAVING REDUCED HEIGHT PISTONS

BACKGROUND OF THE INVENTION

This invention refers to modifications to the current two-stroke cycle internal combustion engines, those which execute one full cycle for each rotation of the crankshaft, with the difference that it uses shorter pistons and the fuel does not enter the engine crankcase. For this purpose, it is proposed: a) To use piston rods solid with the pistons, similar to those used by engines using double acting pistons (such as steam engines); b) to install rotary valves in the transfer and exhaust ports; c) operate one-way flow valves directly by pressure differential; d) to install an auxiliary mechanism to pump lubricant to the piston rings.

DESCRIPTION OF THE PREFERRED EMBODIMENTS

Figure 1:
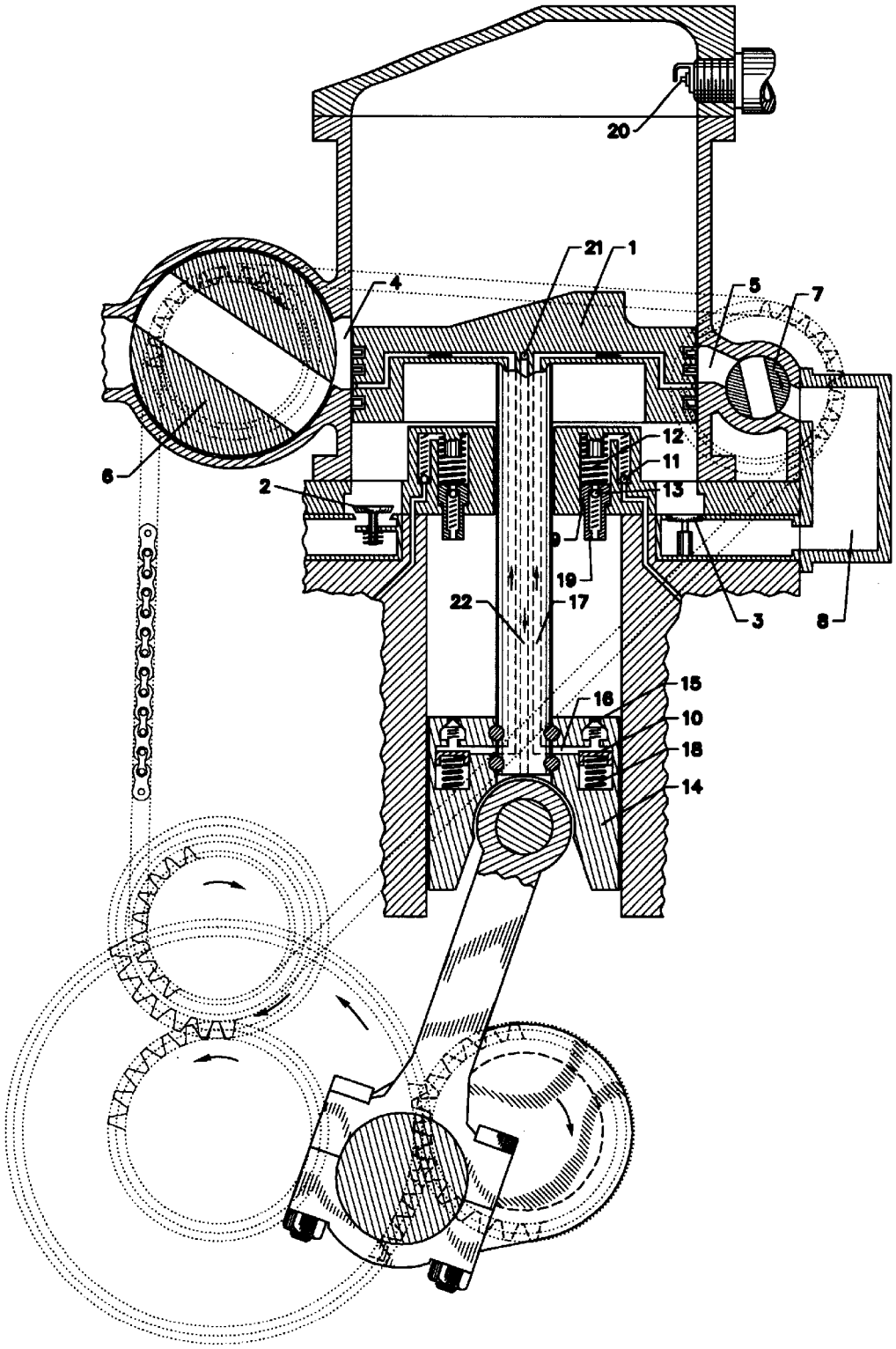
FIG. 1 is an elevation of a vertical section taken through the center line of the cylinder axis embodying the improving features of this invention including an elevation of the connecting rod to obtain the relative position between the crankshaft, the piston and rotary valves. Also shown in this figure, in dotted lines, is the projection of the movement transmission mechanisms, which are the pinions and chains for synchronizing the rotating movement of the crankshaft with the rotary valves.
Figures 2, 2A:
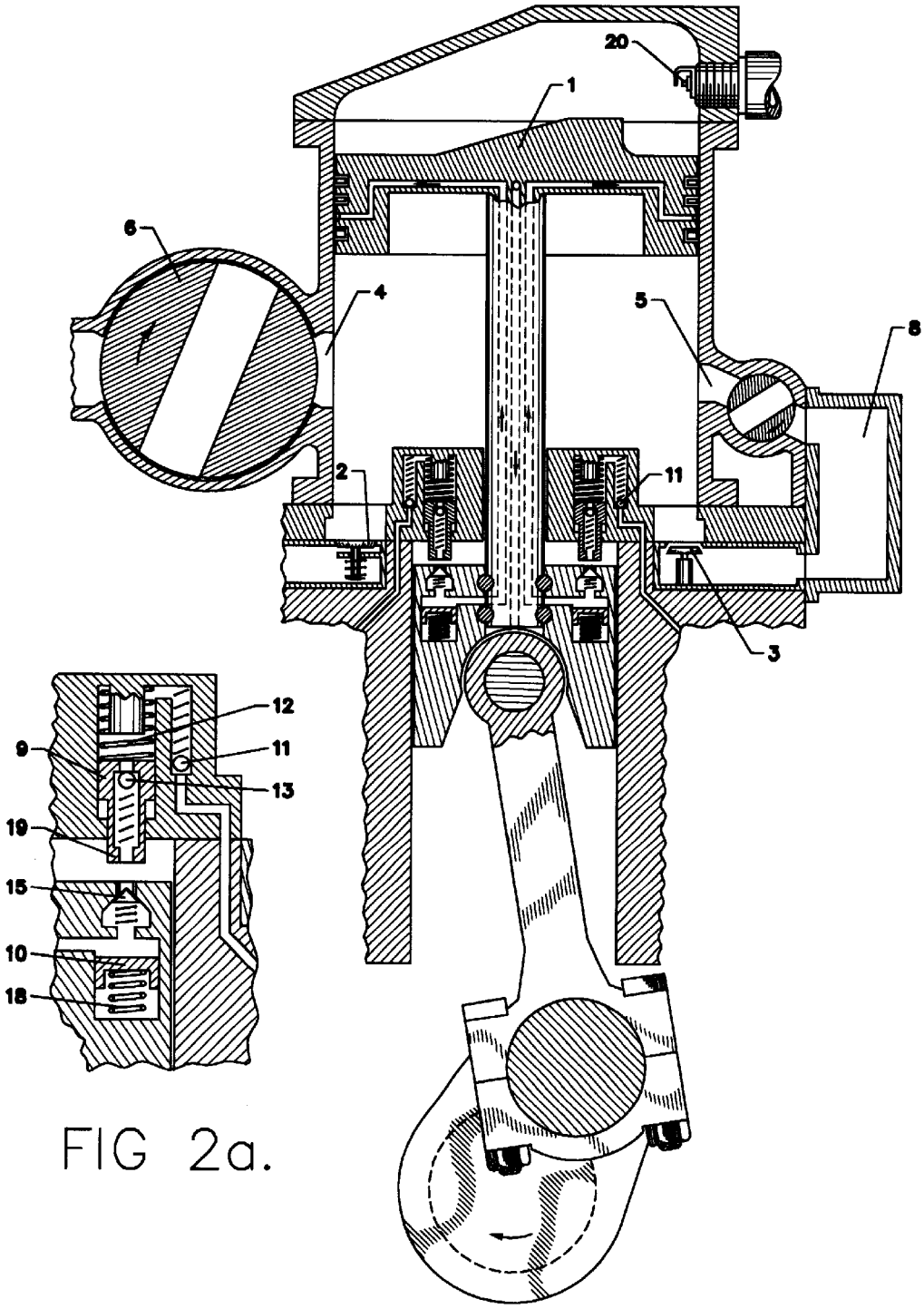
FIG. 2 and FIG. 3 are similar to FIG. 1 but with the piston in different positions and the corresponding positions of the valves and other accessories.
FIG. 2*a* is a larger scale detail of part of FIG. 2, showing one of the symmetrical sides of an auxiliary lubrication system for the piston rings.
Figure 3:
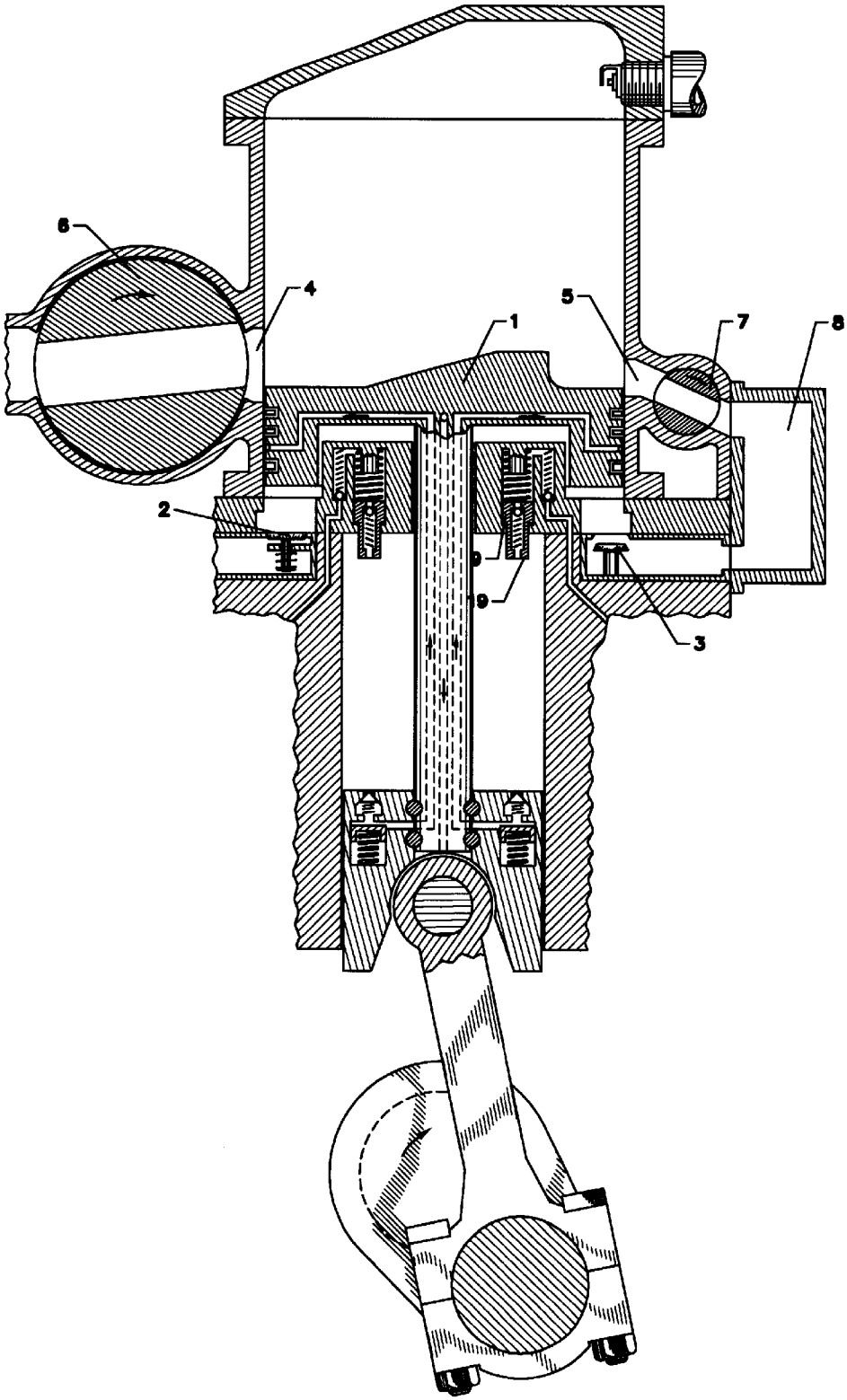

Let us suppose, in FIG. 1 that the piston 1 is on the ascending stroke, then the mixture enters the lower part of the cylinder via one-way valve 2, which is opened directly by pressure difference; there is no entry or exit of gases or fuel-air mix ports 4 and 5, because rotary valves 6 and 7 are closed. After the spark has been produced by spark plug 20 and the piston reaches top dead center, the piston starts descending as shown in FIG. 2, valve 2 closes and valve 3 opens, operated by pressure difference, the fuel-air mix being forced by the piston into inlet space 8. As the piston continues to descend port 4 is opened by rotary valve 6 being in the open position, as is shown in FIG. 3, enabling the exhaust gases to be discharged. As the piston continues to descend it uncovers inlet port 5 at the moment rotary valve 7 is opened. It is then that due to a pressure difference, the fuel-air mix flows from chamber 8 into the cylinder. Piston 1 them passes bottom dead center and begins to ascend again, opening valve 2 and closing valve 3 due to the pressure difference. Rotary valves 6 and 7, as shown in FIG. 1, have moved from the open to closed position, both being closed before the ascending piston completely covers the exhaust port. This prevents that when the piston continues its ascending stroke, fuel-air mixture escapes through the exhaust port, and that when the lower periphery of the piston opens transfer port 5, rotary valve 7 prevents the fuel-air mix, held in the chamber 8, from returning to the lower part of the cylinder via the said transfer port.

Figure 4:
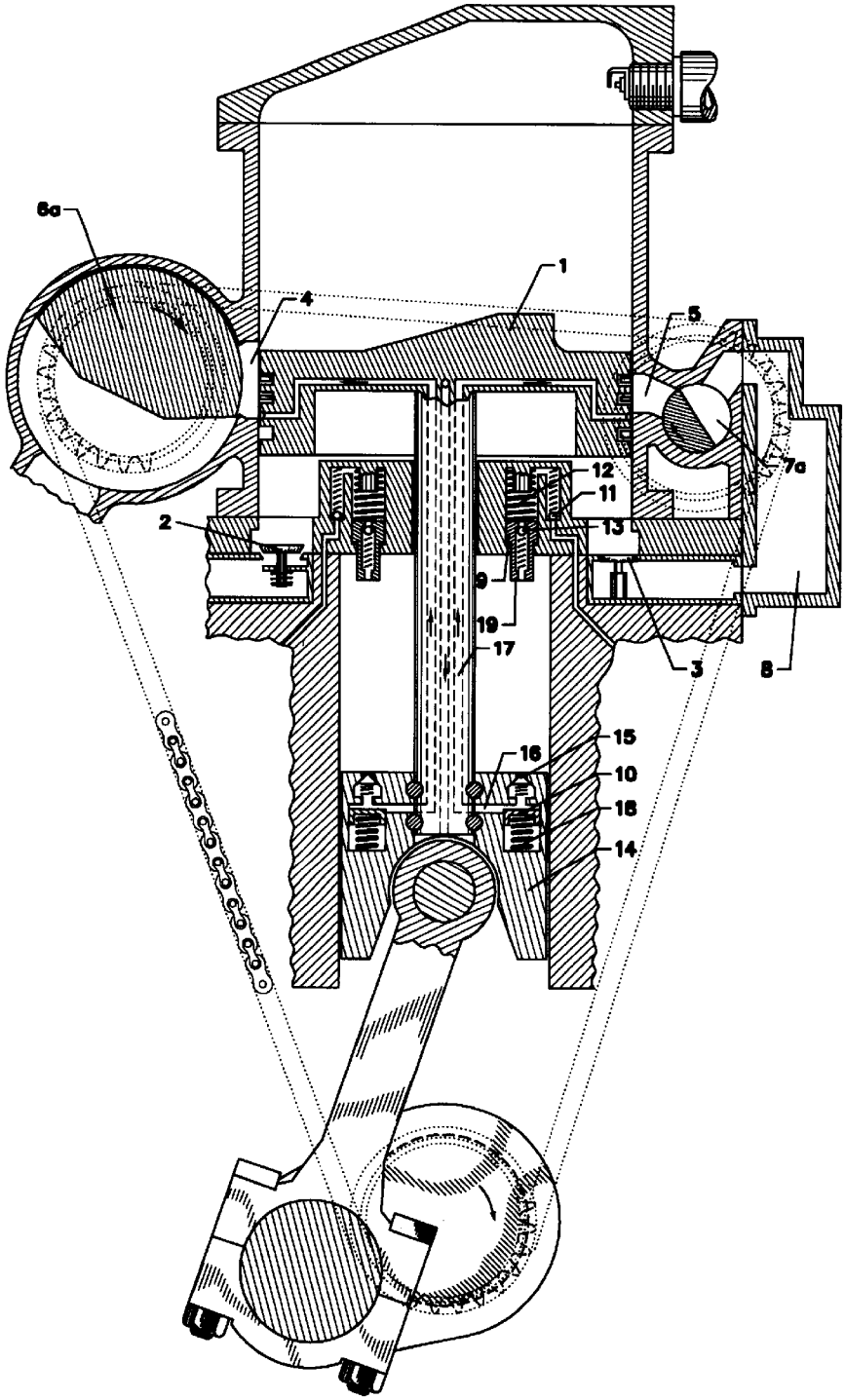
FIG. 4 shows a different type of rotary valve used for the same purpose. Also shown in this figure, in dotted lines, is the projection of the movement transmission mechanisms, which are the pinions and chains for synchronizing the rotating movement of the crankshaft with the rotary valves.

Naturally, the motion of the rotary valves must be synchronized between each other, as well as the crankshaft which is driven by the piston. In cases that cylindrical rotary valves with center holes, such as, those shown in FIG. 1, FIG. 2 and FIG. 3, are employed producing two openings every full revolution, it will be understood that they must rotate al half RPM of the crankshaft. To establish the arc or fraction of a revolution, at which each of the valves must remain opened for each full revolution of the crankshaft, the hole size must be related to the valve diameter. This means that suitable dimensions according to each given diameter of valve must be selected to achieve the most suitable fraction of a revolution or arc of the valve timing. It is also possible to use cylindrical valves that rotate at the same RPM as the crankshaft, i.e. there is only one opening for such revolution of the valve by using valves of shapes 6*a* and 7*a* of FIG. 4, or similar designs, which are obtained by cutting a cylinder geometrically along its side by one or more secant planes. In this case the edges perpendicular to the plane of the drawing of the entrance and exit of the valve with its axis can not be in the same plane but form a dihedral angle; the value of which will match the diameter and the width or opening of the valve, it being possible to establish the best arc or fraction of revolution for which it must stay open for the purpose required. In FIG. 4 the position of the piston with respect to the crankshaft is the same as in FIG. 1.

By means of this system, a very high volumetric efficiency may be obtained in the suction and pre-compression of the fuel mixture. For this purpose, the lower inner face of each piston must be parallel to the upper surface of the plate forming the base of the cylinder and separating it from the crankcase, as can be seen from FIG. 3. The minimum space between the two parallel surface can become insignificant, this way improving the volumetric efficiency to its maximum level.

In this system, the same as in all engines using double acting pistons, some way of lubricating piston rings is necessary to ensure frictionless motion in the cylinder. With respect to this, I am including, as part of the system that I propose, a device consisting of small pistons 9 and 10 aligned one against the other, piston 9 located in the lower part of the plate separating the cylinder from the crankcase and, with spigot 19, 10 located in the crosshead 14 which links the connecting rod to the piston rod, as is shown in FIGS. 1, 2 and 3.

The lubricant for the general lubricating system of the engine passes through check valve 11, entering the free space left by small piston 9 which is displaced by spring 12; check valve 13 located at the center of small piston 9, together with check valve 11, allows lubricant to flow in one direction only. When the piston on its ascending stroke reaches top dead center, crosshead 14 also reaches its respective top dead center and pushes spigot 19. It is at this moment that small piston 9 enables the lubricant to pass through the center hole since the pressure will exceed the resistance of the spring of check valve 15, putting into operation the small crosshead piston 10. In this manner a portion of the lubricant will pass through conduct 16 towards the respective conduct 17 situated close to the center of the piston rod by which the lubricant will pass to a circular space between two piston rings. Another portion of the lubricant will displace small piston 10, compressing spring 18, temporarily accumulating lubricant pressure, which will continue to flow through the oil conducts to the piston rings, for a moment after the crosshead leaves the top dead center. The lubricant, after running through the aforementioned circular space between two piston rings, returns via conduct 21, perpendicular to the plane of the figure, which in turn joins with conduct 22, situated close to the center of the piston rod, until arriving at the lower end of the said piston rod, discharging the said lubricant into the engine crankcase.

With this system it is hoped to overcome deficiencies of current two stroke engines. For instance, it will not be necessary to mix lubricant with the fuel, which results in a cleaner combustion; a dry crankcase will not be required, and the advantage of pressure lubrication will be achieved. In addition, a better volumetric efficiency will be obtained since the limitations of a divided crankcase to be employed as part of the fuel-air mix pre-compression system will not be necessary. Also with this system it is possible to have more efficiency than with the present four stroke cycle engines which complete one power stroke every two crankshaft revolutions; apart from having twice the power strokes per cylinder, the mechanism is simpler and weighs less.

PREAMBLE: A two stroke internal combustion engine of the type where gases displaced by the underside of each piston move to the space above the piston, in which each cylinder has an inlet port, and diametrically opposite to it there is an exhaust port, each piston also having a short skirt and a rigid piston rod in turn passing through a hole in a plate located in the lower part of each cylinder, forming in conjunction with the underside of the said piston an enclosed volume which becomes a volumetric displacement chamber similar to a compressor, with the said piston rod connected to a sliding cross head, and then by means of a connecting rod, to the crankshaft.

What is claimed is:

1. The two stroke internal combustion engine described in Preamble, modified by including for each of its cylinders, a rotary valve synchronized to the rotation of the crankshaft, preceding the aforementioned inlet port, a rotary valve following the exhaust port, also synchronized to the rotation of the crankshaft, both of these valves, when closed, combining to form part of a hermetic volumetric displacement chamber.

2. In the two stroke engine described in Preamble and claim 1, the addition of a group of check valves located in the plate at the bottom of each cylinder permitting a one-way flow of gases into the said displacement chamber, a group of check valves also located in the said bottom plate, permitting the one-way flow of gases discharged from the said displacement chamber, a passage connecting the outlet from the group of check valves exhausting from the displacement chamber, to the inlet of the rotary valve situated before the inlet port, this passage being the only means of transferring gases from the displacement chamber under the moving piston to the combustion chamber above it.

3. In the two stroke engine described in Preamble, a lubrication system for the surfaces between each moving piston of the engine and its respective cylinder wall consisting of the combination of a small piston with a retractable pin, housed in the said base plate of the respective cylinder, the said pin projecting below the base plate of the cylinder, and parallel to the piston rod, the small piston having a discharge duct through the pin and an inlet duct fitted with a retaining valve for oil coming from the engine lubrication system, a small piston recessed into the corresponding cross head, with retaining valve and oil discharge duct to the periphery of the respective moving piston of the engine, the retractable pin from the oil supply duct being aligned with the inlet duct of said small piston in the cross head and making contact with it every revolution of the crankshaft.

4. In internal combustion engines mentioned in the preamble and claim 3, the combination of multiple small pistons housed in the wall indicated, situated in the bottom part of the respective cylinder, each one of the said small pistons being aligned with the corresponding other one embedded in the respective crosshead.

* * * * *